United States Patent [19]

Shirley et al.

[11] 3,932,831

[45] Jan. 13, 1976

[54] VARIABLE RESISTANCE DEVICE

[75] Inventors: Ronald A. Shirley, La Habra; Robert J. DeLong, Temple City, both of Calif.

[73] Assignee: Spectrol Electronics Corporation, Industry, Calif.

[22] Filed: June 25, 1974

[21] Appl. No.: 482,938

[52] U.S. Cl. ..... 338/143; 338/167; 338/170; 338/182

[51] Int. Cl.[2] ..... H01C 10/24

[58] Field of Search ..... 338/98, 105, 143, 148, 338/153, 162, 164, 167, 168, 169, 170, 174, 182, 184

[56] References Cited

UNITED STATES PATENTS

| | | | |
|---|---|---|---|
| 2,308,422 | 1/1943 | McAllister | 338/169 X |
| 2,857,496 | 10/1958 | Louis | 338/164 |
| 2,926,322 | 2/1960 | Guggenheim | 338/167 |
| 3,139,601 | 6/1964 | Kruse et al. | 338/143 |
| 3,242,450 | 3/1966 | Bourns et al. | 338/164 |
| 3,314,036 | 4/1967 | Kruse | 338/143 |
| 3,362,003 | 1/1968 | Beitner et al. | 338/174 |
| 3,497,855 | 2/1970 | Mueller et al. | 338/143 |
| 3,579,169 | 5/1971 | Dickinson | 338/170 |

*Primary Examiner*—Volodymyr Y. Mayewsky
*Attorney, Agent, or Firm*—J. Raymond Curtin; Barry E. Deutsch

[57] ABSTRACT

A variable resistor including a resistance element, a housing supporting the element, and rotary means including a shaft located within the housing. Means are provided to restrain rotational movement of the rotary means except upon application of a relatively large magnitude predetermined force. The restraining means includes a resilient member and a second member operable to develop a frictional force to prevent undesired rotation of the rotary means.

10 Claims, 8 Drawing Figures

VARIABLE RESISTANCE DEVICE

BACKGROUND OF THE INVENTION

This invention relates to a variable resistance device, and in particular to such a device having means to restrain rotation of the shaft thereof except upon application of a relatively large magnitude rotational force.

Variable resistance devices, such as potentiometers, are employed in many varied applications. In many applications, the resistance device is positioned adjacent operating machinery whereat the device is exposed to vibrational forces.

Additionally, in numerous applications, many resistance devices are often installed adjacent each other in an operating panel or console. In such applications, there is constant movement of personnel about the panel or console. In the course of such personnel movement, inadvertent and undesirable readjustment of the setting of the device may occur as a result of unintentional contact between personnel and device. Additionally, many times a person or operator, in attempting to set a resistance device to a desired resistance value, may accidentally disturb the setting of an adjacent resistance device.

To prevent accidental changes in the resistance value of a variable resistance device, many of such devices employ means to prevent rotation of the device except upon application of a predetermined rotational force to the shaft thereof. Many of such rotation preventing means include means to provide an axial load on the shaft or other rotary components of the variable resistance device to prevent the undesired rotation. Although, such axial load producing means effectively prevent undesired rotation, the axial loading tends, in some instances, to push the various components of the resistance device apart. Accordingly, it has been found that it is more desirable to provide radially acting forces to prevent undesired setting changes.

Heretofore, the known means for producing radial restraining forces have been installed and become operational prior to the total assembly, calibration, and inspection of the resistance device.

During calibration and inspection procedures, the rotary assembly of the resistance device is rotated many times to insure a high degree of accuracy. The additional force required during calibration and inspection to overcome the frictional force created to prevent undesired rotation decreases production and has a tendency to increase worker fatigue.

SUMMARY OF THE INVENTION

Accordingly, it is an object of the invention to prevent undesired rotation of the rotary means of a variable resistance device without producing worker fatigue and adversely affecting production schedules.

It is a further object of this invention to prevent undesired rotation by creation of radially acting frictional forces.

It is a further object of this invention to create such radially acting forces after all other parts are assembled and the resistance device has been tested and calibrated.

These and other objects of the present invention are obtained in a variable resistance device of the type having a resistance element enclosed by a housing and further having a contact element adaptable to slidably engage the resistance element in response to rotary movement of a rotary assembly of the resistance device. Movement of the rotary assembly is restrained except upon application of a relatively large magnitude predetermined force, the restraining means including resilient means and a member operable to urge the resilient means radially into firm contact with the rotary means whereby a relatively large magnitude frictional force is developed between the engaging surfaces of the urging member, resilient means and rotary assembly. The magnitude of the rotation producing force must exceed the magnitude of the frictional force in order to reset the resistance device to a different resistance value.

In a first embodiment, the frictional force is of a fixed magnitude. In a second embodiment of the instant invention, the magnitude of the frictional force may be varied.

DESCRIPTION OF THE PREFERRED EMBODIMENTS

Figure 2:
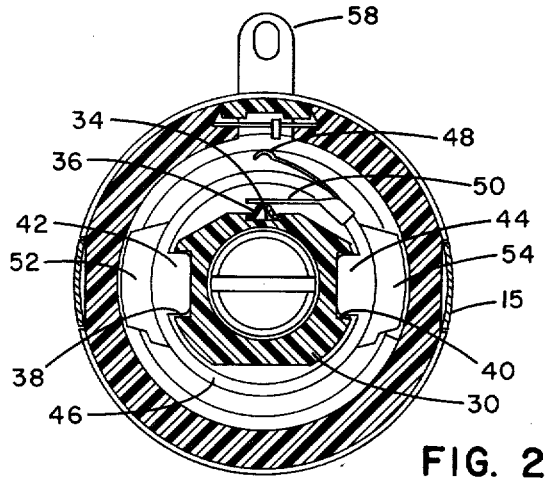
FIG. 2 is a sectional view taken along line 2—2 of FIG. 1.
Figure 1:
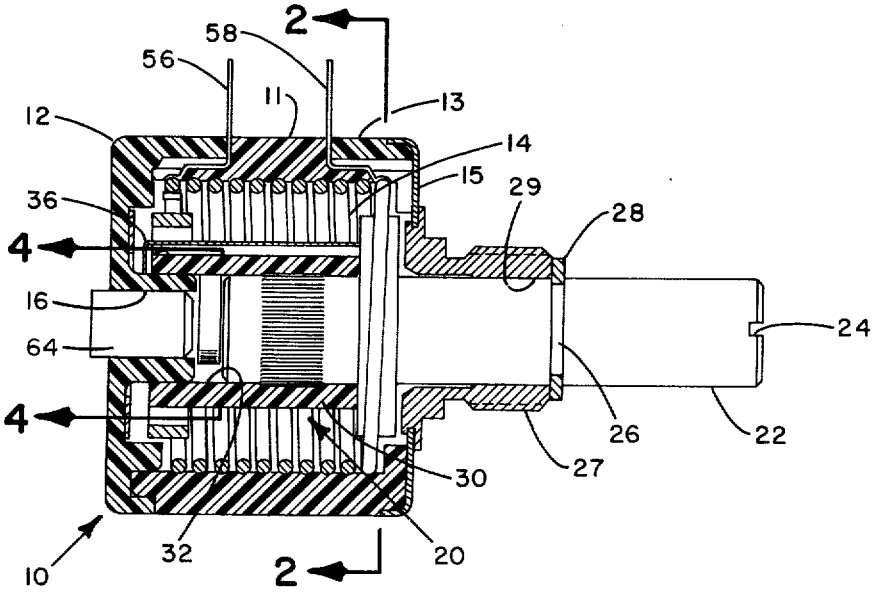
FIG. 1 is a longitudinal sectional view of a variable resistance device including the present invention.

Referring now to the drawings and in particular to FIGS. 1 and 2, there is shown a variable resistance device including the invention herein disclosed. In referring to the various Figures of the drawings, like numerals shall refer to like parts.

The variable resistance device includes a housing 10 comprising a tubular, substantially cylindrical body member 11, formed from a non-conductive material such as glass filled phenolic. Member 11 preferably has a helical retaining groove formed on the major portion of its internal cylindrical surface. The helical groove is provided for receiving therewithin a helically wound resistance element 14 which is secured by conventional techniques, for example by welding.

Housing 10 further includes a rear annular plate 12 formed from a non-conductive material such as glass filled nylon and having a bore 16 provided therethrough. At the opposite or front end of the housing, there is provided a filler piece 13, formed from a suitable non-conductive material such as glass filled nylon. The filler piece is joined to cylindrical member 11 via retaining ring 15, which is crimped over both the filler piece and cylindrical member in the manner illustrated.

The variable resistance device further includes a rotor assembly 20 comprising shaft 22 centrally located within housing 10 and extending longitudinally thereof. Shaft 22 includes slot 24 at one end thereof. Slot 24 is provided to receive a tool, for example a screwdriver, for adjusting the resistance device to obtain desired resistance value therefrom. The shaft includes axial groove 26 in which retaining ring 28 is placed to prevent axial movement of shaft 22. A machined, threaded panel placement and shaft bearing stud 27 is located between retaining rings 15 and 28, the stud being joined to tubular member 11 via ring 15. Stud 27 has a bore 29 through which shaft 22 extends.

Rotor assembly 20 further includes a substantially cylindrical rotor 30 formed from a suitable non-conductive material such as glass filled nylon and having a bore 32 provided therethrough for receiving the shaft. Bores 16, 29 and 32 are coextensive. The shaft and rotor are united so that rotation of the shaft causes similar rotation of the rotor.

As more clearly shown in FIG. 2, rotor 30 has an axially extending groove 34 formed in the top surface thereof. A conductor element 36 is disposed within axially extending groove 34. Conductor element 36 functions as a collector. As is also more clearly illustrated in FIG. 2, rotor 30 further includes two additional axially extending grooves 38 and 40. Grooves 38 and 40 are provided on opposed surfaces of rotor 30.

Grooves 38 and 40 are provided for receiving tabs 42 and 44 extending radially inward from slider block 46, formed from a suitable non-conductive material such as plastic. Slider block 46 is substantially cylindrical in configuration and includes wiper element 48 adapted to slidably engage resistance element 14 in response to rotary movement of the slider block. The slider block further includes a second contact 50 adapted to contact conductor 36. Conductor 36 terminates in a slip ring (not shown) which provides means for externally connecting the conductor to an electrical conduit. The slider block further includes outwardly extending fins 52 and 54 which are provided to engage stops formed at either end of the housing to prevent further rotation of the rotor assembly after the slider block has traversed the entire length of the resistance element in response to rotation of the shaft in either clockwise or counter clockwise directions. Terminals 56 and 58 are connected to either end of the resistance element via conventional means, for example welding.

The construction of the resistance device hereinabove described is conventional within the art. As is manifest, rotation of shaft 22, results in rotor 30 united therewith to similarly rotate, causing slider block 46 to translate along the axial length of the resistance element whereby the resistance value of the device may be varied.

As previously noted, resistance devices of the type herein disclosed are employed in many applications where they are subjected to vibrational forces or other forces which may produce unwarranted rotation of the rotor assembly to thereby change the resistance value of the device. Obviously, accidental or inadvertent changing of the resistance value may go unnoticed and thereby provide undesirable results.

To overcome the foregoing, it has been the practice within the art to provide means whereby unwarranted movement of the rotary assembly is prevented. However, as noted before, there have been some drawbacks in the prior art devices heretofore employed to prevent unwarranted rotation of rotor assemblies.

Figure 3:
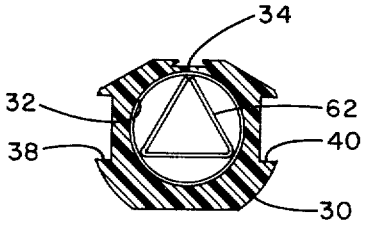
FIG. 3 is a sectional view illustrating a detail of the present invention.
Figure 4:
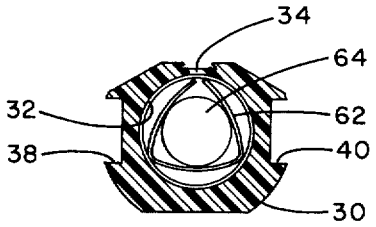
FIG. 4 is a view similar to FIG. 3, taken along line 4—4 of FIG. 1, providing a further view of the instant invention.

With particular reference to FIGS. 1, 3 and 4, there is disclosed a first embodiment of the instant invention which obviates the defects of the prior art. In particular, there is provided within bore 32 of rotor 30 a spring-like member 62 formed in the shape of an equilateral triangle.

After the resistance device has been assembled and calibrated, a pin or similar device 64 is inserted through bore 16 of housing 10. If desired, pin 64 may be inserted before assembly and calibration; however prior to the completion of the foregoing manufacturing steps, pin 64 is maintained in spaced relation relative to spring 62. Pin 64 urges the sides of spring 62 radially outward. Pin 64 is axially movable relative to spring 62 and rotor assembly 20; however once the pin has been brought into engagement with the spring, it is thereafter stationary relative to the rotor assembly. A frictional force is developed between the outer surface of stationary pin 64, spring 62 and the inner surface of rotor 30. The frictional force restrains rotation of rotor assembly 20 except upon application of a force of relatively large magnitude to shaft 22. Thus, the restraining means comprising the spring and pin prevents accidental or unwarranted rotation of the rotor assembly due to vibration or other relatively small magnitude forces as applied to the resistance device.

FIG. 3 illustrates the restraining means of the instant invention in a relaxed state prior to insertion of pin 64. FIG. 4 illustrates the restraining means after insertion of the pin whereby the sides of the spring member 62 have been urged radially outward to accommodate the pin whereby the desired frictional force is developed.

Figure 5:
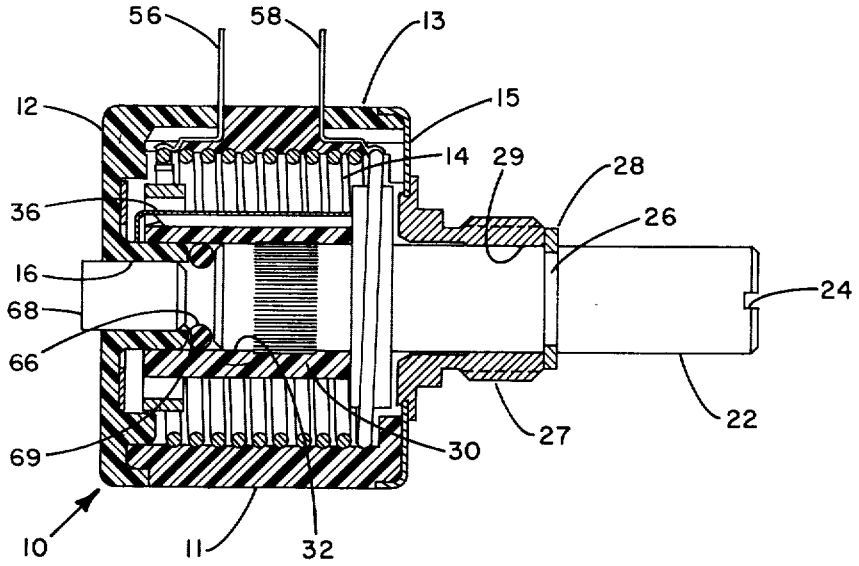
FIG. 5 is a longitudinal sectional view of a variable resistance device illustrating a second embodiment of the present invention.
Figure 6:
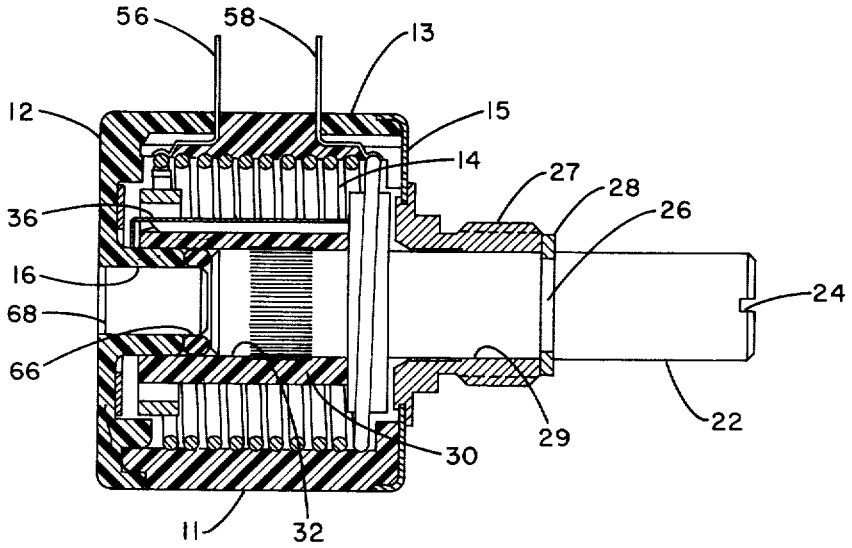
FIG. 6 is a view similar to FIG. 5 further illustrating the second embodiment of the invention.

Referring now to FIGS. 5 and 6, there is disclosed an alternative embodiment of the instant invention. The resistance device in which the alternate embodiment is provided is identical to that disclosed in FIGS. 1 and 2 and repetition of the description is not deemed necessary. In lieu of spring means 62, an O-ring 66 is provided within bore 16. FIG. 5 shows the O-ring in a relaxed state, with pin 68 in spaced relation thereto. FIG. 6 illustrates the O-ring after it has been compressed between the outer surface of pin 68 and the inner surface of rotor 30. Pin 68 is axially movable relative to bores 16 and 32. The insertion of the pin through the O-ring compresses the O-ring between the inner surface of the rotor and the outer surface of the pin to develop a relatively large magnitude frictional force between the pin's outer surface, and the inner surface of the rotor. The frictional force prevents the rotor and thus the slider block having contact element 48 in engagement with resistance element 14 from rotating except upon application of a relatively large magnitude force to the shaft. Preferably pin 68 has a tapered surface 69 at the end engaging O-ring 68 to permit insertion of the pin without damaging the O-ring. The invention as illustrated in FIGS. 3, 4, 5 and 6 provides a relatively constant magnitude frictional force to prevent unwarranted rotation of the rotor assembly.

Figure 7:
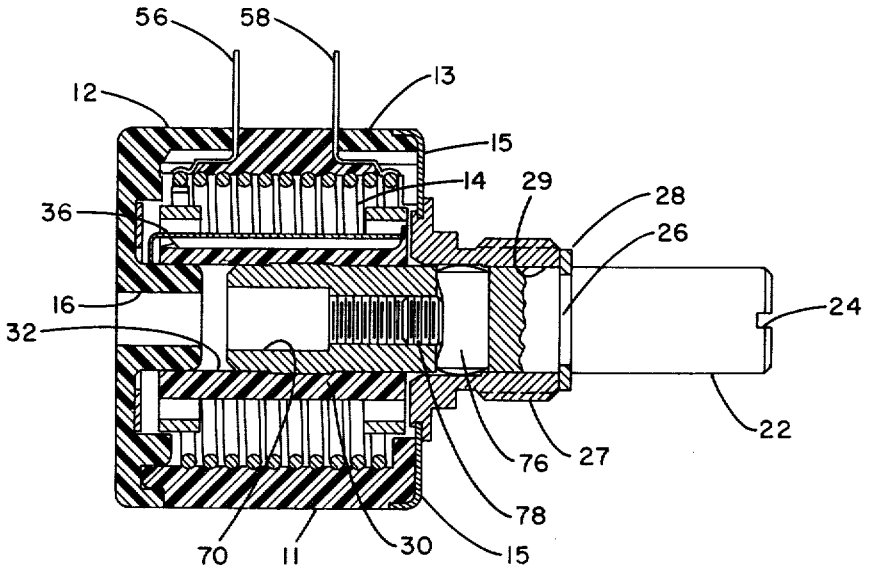
FIG. 7 is a longitudinal sectional view illustrating a second alternative embodiment of the instant invention.
Figure 8:
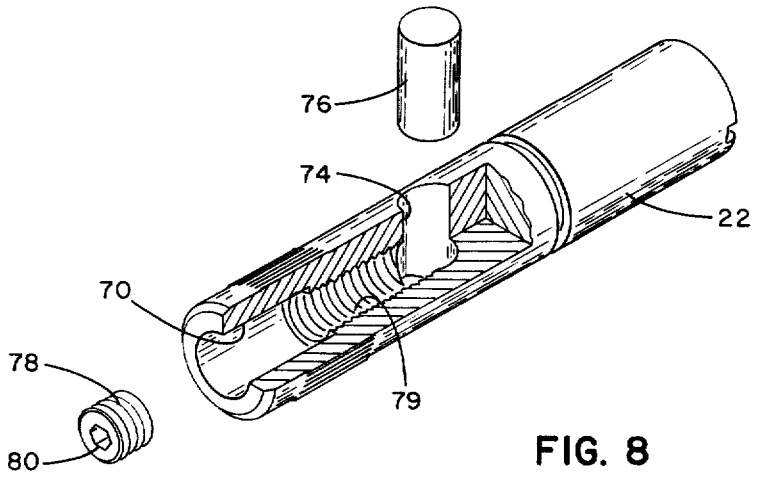
FIG. 8 is a perspective view illustrating details of the second alternative embodiment.

Referring now to FIGS. 7 and 8 there is disclosed a second alternate embodiment of the instant invention. Again, except for differences hereinafter noted, the resistance device disclosed in FIG. 7 is similar to the resistance device hereinbefore described in detail. As shown in FIG. 8, shaft 22 has a bore 70 centrally located therein. The shaft has a groove 74 formed in the bore. A resilient member 76, for example a member formed from nylon or other material having characteristics of relatively great strength, light weight and a high degree of resilience is provided within groove 74 of shaft 22. Bore 72 preferably includes threads 79 for receiving a set screw 78 or similar device. The end of the set screw facing outwardly towards bore 16 has an opening 80 for receiving a tool such as a screwdriver. After the resistance device is assembled and calibrated, an operator may insert the tool into opening 80 of set screw 78 for adjusting the position of the set screw relative to resilient member 76. Prior to final calibration and assembly, the set screw is spaced from the resilient member so that the resilient member is substantially in a relaxed state and shaft 22 may be easily rotated by the application of forces of only small magnitude. After calibration, when it is desired to produce a relatively high frictional force to prevent undesired rotation of the rotor assembly, the set screw is moved into engagement with the resilient member to thereby radially expand the resilient member to increase the frictional force developed between the resilient member and the sides of bore 29 of stud 27. The frictional force thus developed may be varied by adjusting the position of the set screw relative to the resilient member. As the set screw is brought axially towards the resilient member to increase the contact therebetween, the resilient member is expanded to a greater degree radially outward to increase the frictional force thus obtained. If a smaller magnitude frictional force is desired, the set screw may be moved axially away from the resilient member to decrease the contact pressure between the set screw and resilient member.

Particularly, the rotor assembly may be positioned within the housing and the resistance device fully calibrated and inspected prior to moving pins 64 and 68, or set screw 78 into contact with their respective resilient means 62, 66 and 76. Thus, the rotor assemblies may be freely rotated during calibration and inspection procedures. The desired frictional force may thereafter be developed by engagement of the force producing members in the manner heretofore used.

The instant invention prevents undesired rotation of the rotor assembly of a variable resistance device yet accomplishes this desirable result without causing production problems as heretofore encountered with prior art devices.

While preferred embodiments of the instant invention have been described and illustrated, the invention should not be limited thereto, but may be otherwise embodied within the scope of the following claims.

We claim:

1. In a variable resistor including a resistance element, a housing supporting the resistance element, a rotary assembly including shaft means located within said housing, contact means carried by said rotary assembly and being adaptable to slidably engage the resistance element in response to rotary movement of said assembly, and electrical conductor means supported by said housing in engagement with spaced positions on said resistance element, the improvement comprising:

means to restrain rotational movement of said rotary assembly except upon application of a relatively large magnitude predetermined force to said assembly, said restraining means including resilient means disposed radially inward of said rotary assembly and a member having first and second operating positions, said member when in said first operating position being spaced apart from said resilient means to permit substantially free rotation of said assembly, and when in said second operating position being in engagement with said resilient means to expand said resilient means radially outward to develop a relatively large magnitude frictional force between opposed surfaces of said resilient means, said rotary assembly and said member whereby the magnitude of said frictional force determines the magnitude of said predetermined force.

2. The combination in accordance with claim 1, wherein said member compresses said resilient means between a first surface thereof and a surface of said rotary assembly to develop said relatively large magnitude frictional force.

3. The combination in accordance with claim 2, wherein said resilient means comprises an O-ring.

4. The combination in accordance with claim 1, wherein said resilient means comprises an O-ring.

5. The combination in accordance with claim 2, wherein said resilient means comprises a triangular member having resilient sides to accommodate engagement by said member when said member is placed in said second operating position.

6. The combination in accordance with claim 1, wherein said resilient means comprises a triangular member having resilient sides to accommodate engagement by said member when said member is placed in said second operating position.

7. The combination in accordance with claim 1, wherein the magnitude of said frictional force may be varied by selectively positioning said member relative to said resilient means.

8. The combination in accordance with claim 7, wherein said resilient means comprises a member formed from nylon and said other member comprises a set screw.

9. The combination in accordance with claim 1, wherein said resilient means comprises a member formed from nylon.

10. In a variable resistor including a resist-element, a housing supporting the resistance element and having a bore extending through one end thereof, a rotary assembly including shaft means located within said housing, contact means carried by said rotary assembly and being adaptable to slidably engage the resistance element in response to rotary movement of said assembly, and electrical conductor means supported by said housing in engagement with spaced positions on said resistance element, the improvement comprising:

means to restrain rotational movement of said assembly except upon application of a relatively large magnitude predetermined force thereto, said restraining means including resilient means disposed radially inward from said rotary assembly and a member having first and second operating positions, said member being axially movable relative to said bore of said housing, said member when in its first operating position being spaced apart from said resilient means to permit substantially free rotation of said rotary assembly, said member in its second operating position, being moved axially relative to said bore into engagement with said resilient means to expand said resilient means radially outward to develop a relatively large magnitude radially acting frictional force between the opposed surfaces of said resilient means, said rotary assembly and said member, whereby the magnitude of the frictional force determines the magnitude of said predetermined force.

* * * * *